US006591893B1

(12) United States Patent
Ratte et al.

(10) Patent No.: US 6,591,893 B1
(45) Date of Patent: Jul. 15, 2003

(54) SINKER CASTING MOLD

(75) Inventors: Robert W. Ratte, North Oaks, MN (US); Timothy J. Clift, Lino Lakes, MN (US)

(73) Assignee: Water Gremlin Company

( * ) Notice: Subject to any disclaimer, the term of this patent is extended or adjusted under 35 U.S.C. 154(b) by 0 days.

(21) Appl. No.: 10/072,116

(22) Filed: Feb. 8, 2002

(51) Int. Cl.[7] ..... B22C 9/00; B22D 25/06; B41B 11/52

(52) U.S. Cl. ..... 164/137; 164/341; 164/342; 249/160

(58) Field of Search ..... 164/137, 339, 164/341, 342; 249/174, 139, 160, 163

(56) References Cited

U.S. PATENT DOCUMENTS 1,480,191 A * 1/1924 Wilson ..... 164/498
1,562,509 A * 11/1925 Lee et al. ..... 249/82
4,269,385 A * 5/1981 Bowman ..... 249/82
4,664,354 A * 5/1987 Hanna ..... 249/135

* cited by examiner

*Primary Examiner*—M. Alexandra Elve
*Assistant Examiner*—Kevin McHenry
(74) *Attorney, Agent, or Firm*—Jacobson & Johnson

(57) ABSTRACT

An expandable mold for use with metals that expand during solidification with the expandable mold having sidewalls that are forcibly laterally separated to thereby expand the mold cavity sufficiently so as to free at least one portion of the cast article from an interference fit with a first portion of the mold to thereby enable removable of the cast article from an interference fit with a further portion of the mold without fracture of the cast article and for forming a smooth surface finish on the cast article.

21 Claims, 5 Drawing Sheets

SINKER CASTING MOLD

FIELD OF THE INVENTION

This invention relates generally to casting and, more specifically, to casting metal sinkers wherein the liquid metal expands upon solidification causing the cast article to tenaciously adhere to the mold.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Traditional lead sinkers have been used as weights for fishing lines. Because of environmental concerns manufactures have proceeded to make sinkers from other metals or metal alloys. One of the metals ideally suitable for use in sinkers is bismuth since it has a high specific gravity. Unfortunately, bismuth has a peculiar solidification characteristic that makes it difficult and costly to form sinkers therefrom. As bismuth cools it expands rather than shrinks, consequently, upon cooling the bismuth article forms an interference fit with the mold making it extremely difficult to remove. Coupled with the fact that bismuth is a brittle type metal one can easily shatter a bismuth cast article by attempting to drive the cast bismuth article from a mold. The present invention provides a method and mold that allows one to cast sinkers from metals such as bismuth, bismuth alloys or other metals that expand during solidification while at the same time overcoming the peculiar solidification characteristics which normally produces an interference fit between the cast article and the sidewalls of the mold cavity that prevent freeing of the article without damaging the cast article.

SUMMARY OF THE INVENTION

Briefly, the present invention comprises an expandable mold for use with metals that expand during solidification with the expandable mold having sidewalls that are forcibly laterally separated to thereby expand the mold cavity sufficiently so as to free at least one portion of the cast article from an interference fit with a first portion of the mold to thereby enable removable of the cast article from an interference fit with a f further portion of the mold without fracture of the cast article. A further feature of the invention is allowing the metals to enter the solidification phase where expansion occurs one can produces a smooth finish on the cast article.

DESCRIPTION OF THE PREFERRED EMBODIMENT

Figure 1:
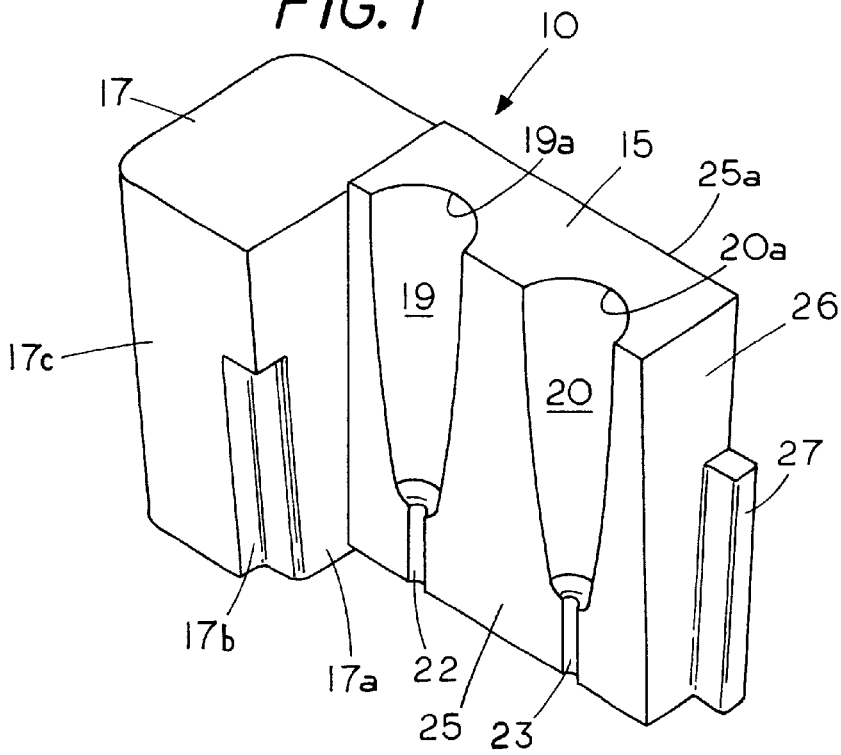
FIG. 1 is a perspective view of two of the mold parts of the present invention.

FIG. 1 is a perspective view showing two mold parts 15 and 17 of a four part expanding mold 10 for casting a fishing sinker from a metal, such as bismuth, that expands upon solidification. Mold part 15 contains a portion of a first mold cavity 19 and a portion of a second mold cavity 20 while mold part 17 is free of any mold cavities. Mold part 17 functions to hold mold part 15 in a fixed position during casting and also allows the mold part 15 to move laterally away from a cast part during a solidification phase. More specifically, mold part 15 is forcibly laterally separated from mold part 17 to thereby expand the mold cavity sufficiently so as to free at least one portion of the cast article from an interference fit with mold part 15. With one portion of cast article free from an interference fit it enables a person to remove the other portion of the cast article from an interference fit with mold part 17 without fracture of the cast article. By allowing the article to begin the solidification process to where the metal expand while still confined in the mold has been found to produce a smoothly finished surface on the sinker. Thus a further feature of the present invention is the formation of an article by a casting process wherein a smooth surface finish is imparted to the article by the compressive action between the mold parts and the cast article.

Figure 2:
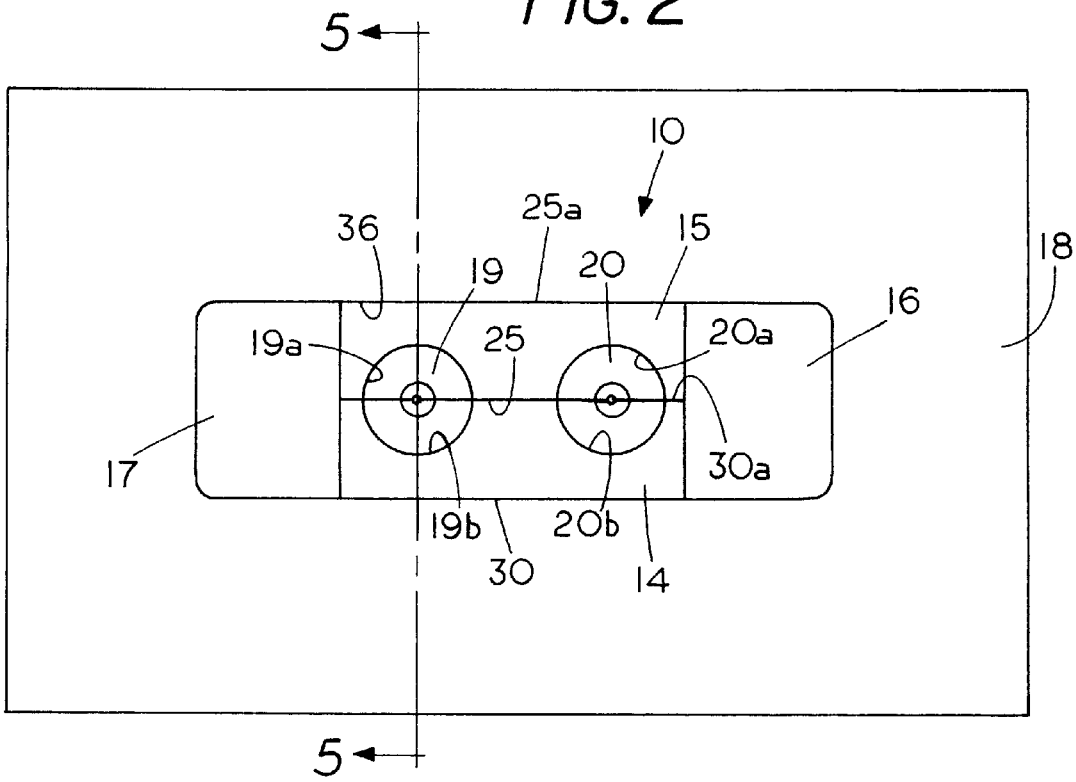
FIG. 2 is a top view of the mold parts of FIG. 1 located in a mold block.

FIG. 2 is a top assembly view of the four part mold 10 showing the four mold parts 14, 15, 16 and 17 held within a mold block 18. Mold parts 14 and 15 are, which contain the mold cavities 19 and 20 are located in a face-to-face condition showing that cavity 19 is formed by sidewalls 19*a* and 19*b* and cavity 20 is formed by sidewall 20*a* and 20*b*. End mold parts 16 and 17 do not contain a mold cavity but hold mold parts 14 and 15 in alignment with each other in mold block 18. Mold block 18 contains a converging sidewall 36 that forms a confinement region to hold mold parts 14, 15, 16 and 17 therein. For purposes of illustrating features of the mold parts 14 and 15 reference should be made to FIG. 3 which shows a top view of the two mold parts 14 and 15 located in face-to-face engagement for forming first mold cavity 19 and second mold cavity 20. A passage 22 connects to mold cavity 19 and a passage 23 connects to mold cavity 20. Located on end 26 of mold part 15 is an angled tongue 27 and located on end 26*a* is an angled tongue 27*a*.

Similarly, located on end 38 of mold part 14 is an angled tongue 37 and located on end 38*a* is an angled tongue 37*a*.

Figure 3:
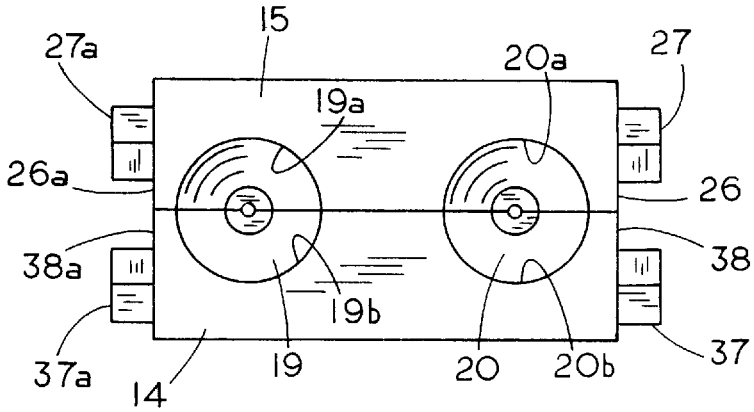
FIG. 3 is top view of two of the mold parts for forming a cavity for casting an article therein.
Figure 3A:
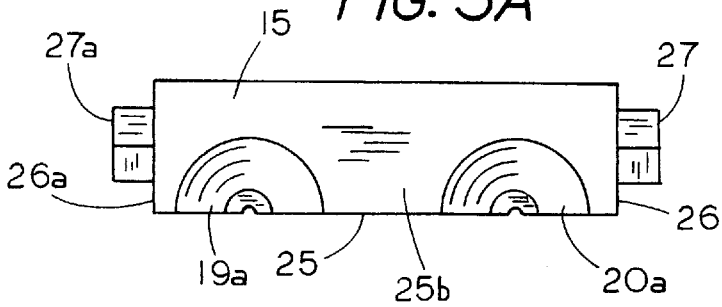
FIG. 3A is a top view of one of the mold parts of FIG. 3.

A reference to FIG. 3A shows an isolated top view of mold part 15 illustrating mold part 15 with a planer face 25 having a top surface 25*b*. In the embodiment shown the mold parts 15 and 14 are identical to each other so that when placed face-to-face they form a symmetrical mold cavity 19 and 20.

Figure 4:
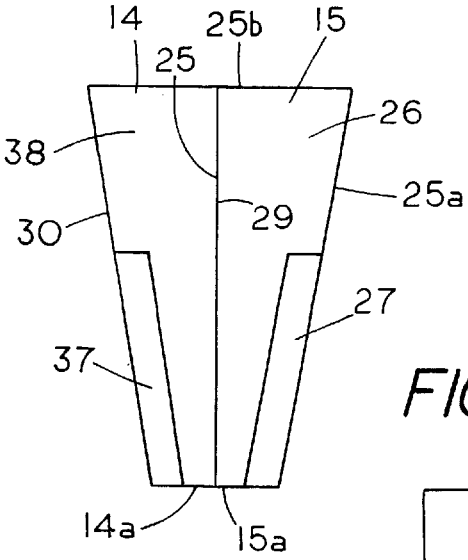
FIG. 4 is an end view of the mold parts of FIG. 3.

FIG. 4 is an end view of the mold parts 14 and 15 located in a face-to-face condition showing tongue 27 extending along one side of part 15 and tongue 37 extending along one side of mold part 14 with the tongues 37 and 27 diverging away from an apex end 14a of mold part 14 and an apex end 15*a* of mold part 15. Face 25 of mold part 15 is in engagement with face 29 of mold part 14. Note, outer face 25*a* of mold part 29 forms an acute angle with face 25 and similarly outer face 30 of mold part 14 forms an acute angle with face 29 so that when the mold parts 14 and 15 are in a face-to-face condition they converge toward the apex ends of the mold parts 14 and 15.

The expansion mold 10 illustrated in FIGS. 14 shows a split mold where the two separate mold parts 14 and 15 cooperate to form mold cavities that are laterally separated during the solidification phase of the cast article. The solidification phase as used herein is meant the range of solidification conditions wherein the metal takes on a final shape and continues to cool until the metal reaches a final dimensional state. That is, the mold parts 14 and 15 are laterally forcibly separated any time after the molten metal reaches a final shape but not necessarily a final dimensional state although the mold parts could also be separated when the cast article reaches a final dimensional state. With the present invention as long as one allows the cast article to reach a final shape but not necessarily a final dimension state one can begin the mold part separation process. A further embodiment illustrated in FIGS. 7–10 shows an expanding mold wherein a single mold part contains a plurality of cantilevered segments that cooperate to form a mold cavity but laterally separate during the solidification phase.

Figure 4A:
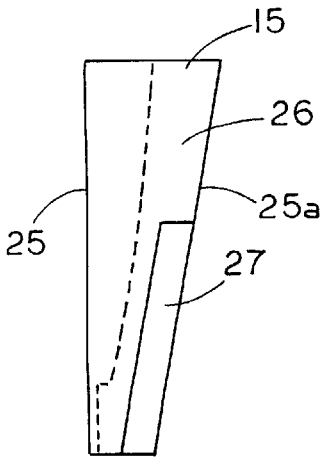
FIG. 4A is an end view of the mold part of FIG. 3A.

FIG. 4A shows an isolated end view of the first mold part 15 having first face 25 having a portion of a mold cavity shown in dotted lines.

A reference to FIG. 2 shows the mold parts 14, 15, 16 and 17 in a casting condition. In the casting condition first mold part 15 has a first face 25 having a portion of mold cavity 19 and 20 therein next to second mold part 14 having a first face 30*a* having a further portion of mold cavities 19 and 20 therein. The first mold part 14 and the second mold part 15 being positionable in a face-to-face to condition to create a mold cavity 19 of a first casting volume and a mold cavity 20 of a second casting volume. The outer face 30 of first mold part 14 is positionable against a first portion of a converging sidewall 36 of mold block 18 and the outer face of second mold part 15 is positionable against an opposed portion of converging sidewall 36 of mold block 18 to hold the first mold part 14 and second mold part 15 in the casting condition.

Positioned proximate one end of mold parts 14 and 15 is an end mold part 16 and positioned proximate the opposite end of mold parts 14 and 15 is a second end mold part 17. All four mold parts 14, 15, 16 and 17 are confined within the sidewall 36 in mold block 18 thereby prevent lateral separation of each of mold parts from each other. Thus, in the casting condition all the mold parts 14, 15,16 and 17 are in face-to-face engagement with each other and the volume of mold cavities 19 and 20 is at a minimum.

Referring to FIGS. 1 and 3, FIG. 3 shows that mold part 15 has a first rectangular shaped tongue 27 extending along an edge of mold part 15 and a second rectangular shaped tongue 27*a* extending along an opposite edge of mold part 15. Similarly, the mold part 14 has a first rectangular shaped tongue 37 extending along an edge of mold part 14 and a second rectangular shaped tongue 37*a* extending along an opposite edge of mold part 14. It is these tongues that cooperate with corresponding mating grooves in the end parts 16 and 17 that permit a controlled lateral separation of the mold parts 14 and 15 which produces an expansion of the mold cavity volume to prevent an interference fit occurring between the cast article and the sidewalls of the mold cavity.

Figure 4B:
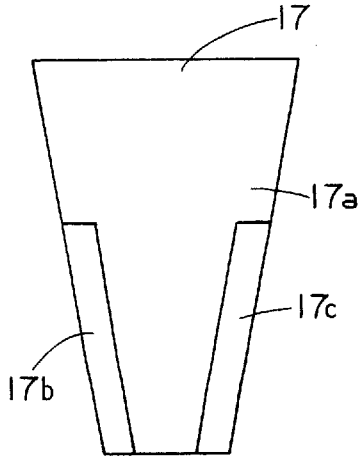
FIG. 4B is an end view of an end mold part.

A reference to FIG. 4B shows an end view of the end mold part 17 revealing the first angled grove 17*b* along one edge of mold part 17 and the second angled grove 17*c* located along an opposite edge of mold part 17. The angled groove 17*b* slidingly engages tongue 37*a* of mold part 14 to permit longitudinal displacement relative thereto and the angled groove 17*c* sliding engages a corresponding tongue 27*a* of mold part 15 to permit longitudinal displacement relative thereto. The longitudinal displacement along the tongues produces a separating lateral displacement of mold part 14 and 15 from each other as the mold parts 14 and 15 are displaced upward. Similarly tongue 27 and tongue 37 engage angled grooves (not shown) in end mold part 16. As mold parts 16 and 17 are identical only end mold part 17 is described herein.

Figure 5:
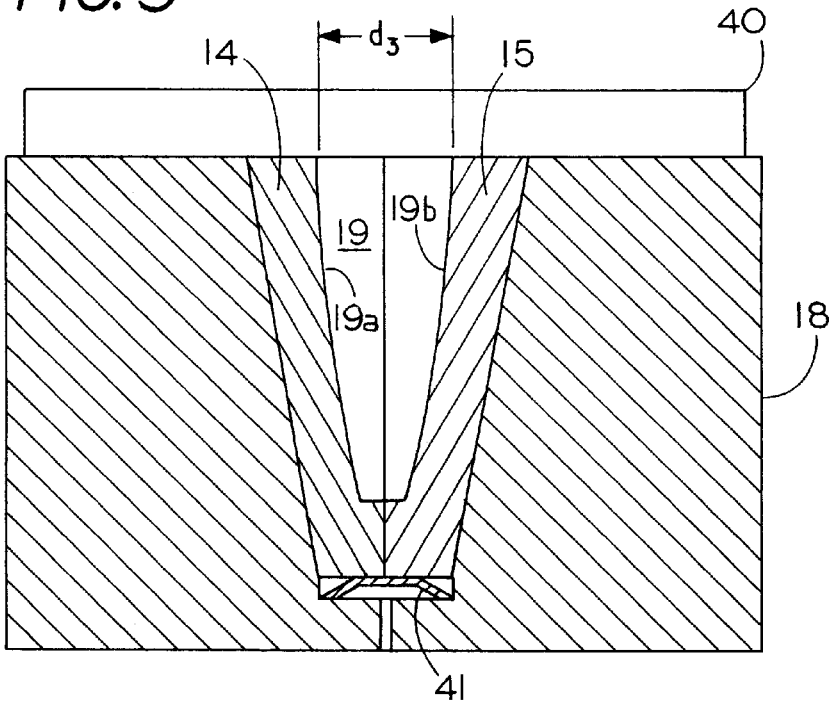
FIG. 5 is a sectional view taken along lines 5—5 showing the mold parts in a minimum volume condition.
Figure 6:
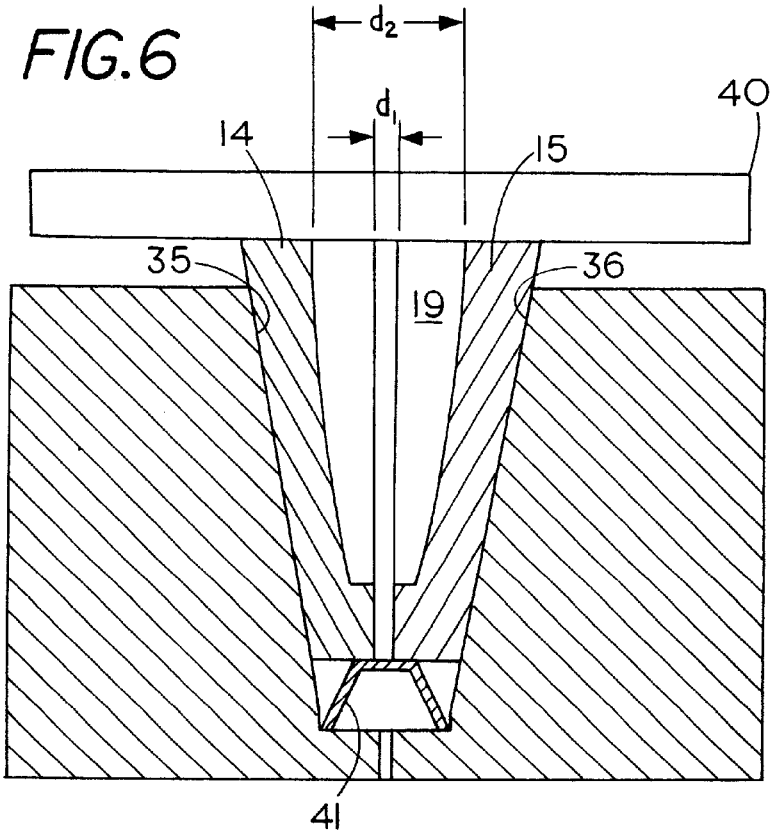
FIG. 6 is a sectional view taken along lines 5—5 showing the mold parts in an expanded volume condition.

In order to appreciate the operation of the invention reference should be made to FIG. 5 and FIG. 6. FIG. 5 shows a view taken along line 5—5 of FIG. 2 with a holding member 40 located on top of mold block 18 to hold the mold parts 14 and 15 in casting position. FIG. 5 shows mold parts 14 and 15 in a face-to-face condition with the volume of mold cavity 19 at a minimum for casting a molten metal that expands during the solidification phase. The cavity 19 is formed by an upwardly diverging side wall 19*a* in mold part 15 and an upwardly diverging side wall 19*b* in mold part 14. Located at the apex end and beneath mold part 14 and 15 is a resilient member 41 that comprises a disc spring or the like. While a disc spring is shown other types of resilient members or force generating members could be used. In the embodiment shown in FIG. 5 the plate 40 maintains the mold parts 15 and 16 in the downward casting condition with the resilient member 41 located in a cavity below mold part 15 and 16. Resilient member 41 provides an upward axial force to cause mold parts 14 and 15 to move upward in mold block 18 but mold parts 14 and 15 are prevented from doing so by plate 40.

FIG. 6 illustrates the mold parts 15 and 16 in the laterally expanded condition due to lifting of plate 40. That is spring 41 forces mold parts 14 and 15 axially upward. The upward force on the apex end of mold parts 14 and 15 together with the tongues thereon which slidingly mate with grooves on end mold parts 16 and 17 forces the mold parts 14 and 15 to laterally separate from each other as the mold parts 14 and 15 move upward. FIG. 5 shows the mold parts 14 and 15 in the face-to-face condition or casting condition while FIG. 6 shows the mold parts 14 and 15 in the spaced apart condition with the separation distance being denoted by distance $d_1$. Note, the diameter of the cavity 19 in the casting condition as shown in FIG. 5 is $d_3$ which is less than the diameter $d_2$ of the cavity 19 in the solidified condition which is illustrated in FIG. 6. That is, as the mold parts 14 and 15 are driven axially upward they are forced to slide along the angled surface 35 and 36 of mold block 18 by the coaction of the tongues of mold parts 14 and 15 with the grooves on end parts 16 and 17. As a consequence the mold cavity 19 therein expands laterally from a first casting volume to a larger solidification volume. By correlating the volume size in the casting condition as shown in FIG. 5 to the after cast condition shown in FIG. 6 one can eliminating the interference fit between the cast article and at least one of the sidewalls of mold parts 14 and 15 by forcing mold parts 14 and 15 laterally away from each other. That is, because the mold parts 14 and 15 move laterally apart from each other it creates additional space to accommodate the metal in the expanded condition thereby allowing one to remove the cast article from an interference fit with a portion of the mold without injuring the mold part or destroying the cast article. When the remaining mold part has 180 degrees or less contact with the cast article the interference fit formed with the remaining mold part and the cast article can be broken without breaking or fracturing the cast article. In addition, since the mold parts are forced to move laterally from each other the mold parts are pulled in a normal direction away from the cast parts, which minimizes damage to the article in the cast condition, because the surfaces of the cast article and the surfaces of the mold do not slide past one another.

FIGS. 7–10 show an alternate embodiment of the expanding mold 52 wherein a one piece collet type mold is used to form a mold cavity. Expanding mold 52 comprises a set of radial segments 52*a*, 52*b*, 52*c*, 52*d*, 52*e*, 52*f* and 52*g* which cantilever outward from an apex base of 52*h* of expanding mold 52. Expanding mold 52 has a frusto-conical shape and is made from a resilient material so that each of the radial segments can be maintained or will return to the separated condition illustrated in FIG. 7 and FIG. 8. Located below the apex of expanding mold 52 is a resilient member such as a coil spring 61 that provides a normal upward force on expansion mold 52.

Figure 9:
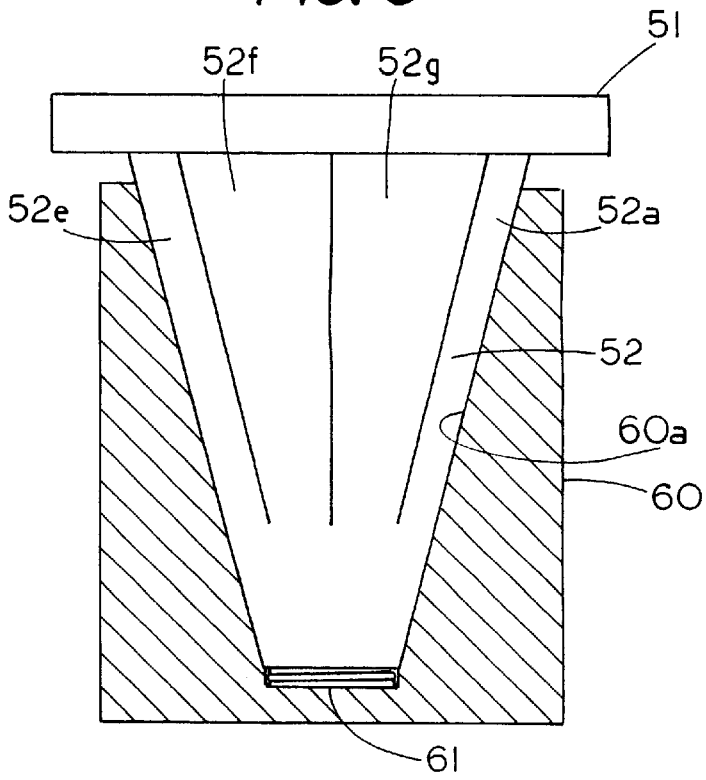
FIG. 9 top view of the one piece expanding mold of FIG. 7 in a minimum volume condition.
Figure 10:
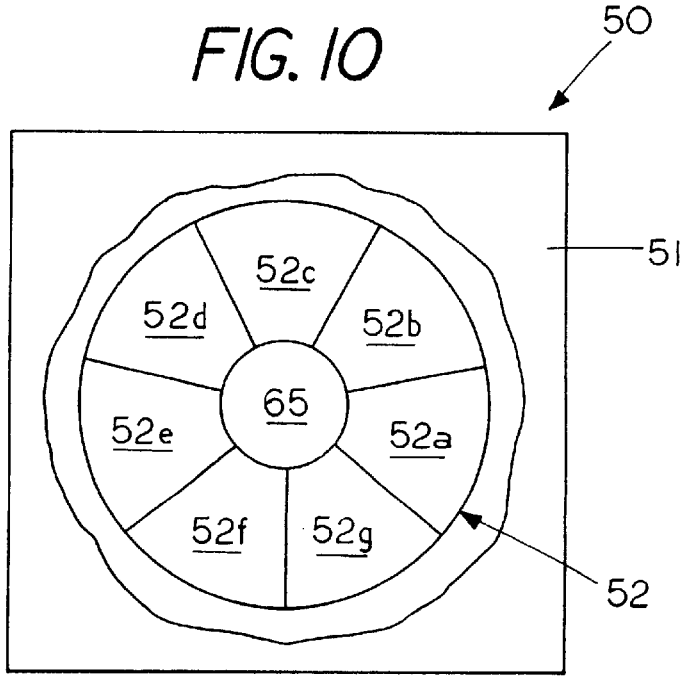
FIG. 10 is a side view of the one-piece expanded mold of FIG. 7 in the minimum volume condition.

A reference to FIG. 9 and FIG. 10 shows the expanding mold 52 in a casting condition having a mold cavity of a minimum volume. Figure shows that the radial segments have been brought into lateral contact with each other by the downward displacement of plate 51 in mold block 60 which is resisted by a compression spring 61. That is, the mold block 60 has a converging sidewall 60*a* that allows the expanding mold 52 to slide therealong while at the same time forcing the radial segments into lateral contact with each other.

Figure 7:
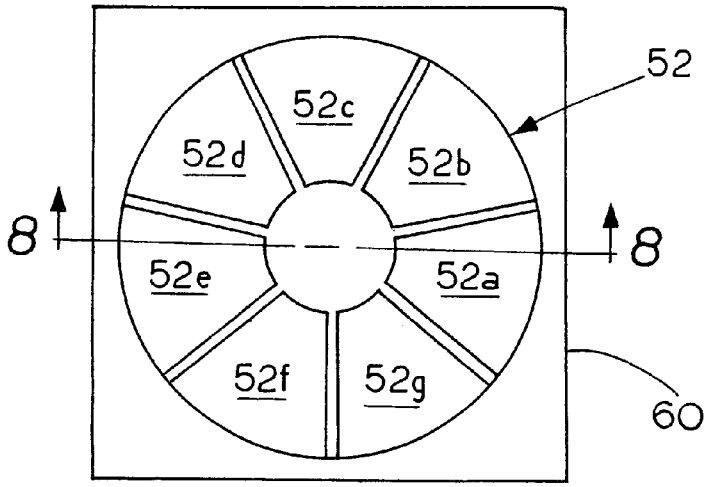
FIG. 7 is an alternate embodiment showing a top view of a one piece-expanding mold.
Figure 8:
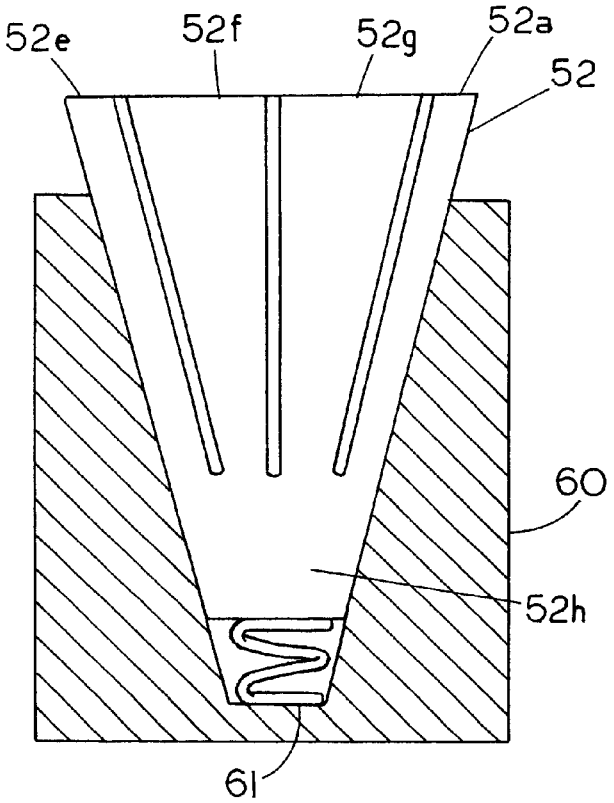
FIG. 8 is a side view taken along lines 8—8 of FIG. 7 showing the one piece-expanding mold in an expanded condition.

FIG. 10 shows a top view, partially in section, revealing expanding mold 52 and the radial segments in a face-to-face condition to form a central, cylindrical-shaped mold cavity 65. In the embodiment shown the mold cavity is formed by the cooperation of multiple segments. When expanding mold 52 is in the condition shown in FIG. 10 the molten metal can flow into the mold cavity 65. As the metal cools the plate 51 can be raised from mold block 60 allowing the spring force of spring 61 to force expanding mold 52 upward in block 60. As it does so the radial segments, which are cantilever type springs laterally separate as shown in FIG. 7 thereby increasing the volume of the mold cavity 65 so that a cast article therein is not held in interference fit by the coaction of sidewalls of the radial segments.

Thus, in the embodiments shown in FIGS. 7–10 each of the segments expand radially outward thereby moving the sidewalls of the segments laterally away from a cast article to eliminate an interference fit between at least a portion of the cast article and a portion of sidewalls of the mold to thereby enable one to free the cast article from any remaining portions of the sidewalls which form an interference fit with the cast article.

Thus the present invention comprises a method of casting a fishing sinker that expands during the solidification phase. One places an expandable mold in a mold block; compress the expandable mold to create a mold cavity having a mold casting volume by contracting the expandable mold within the mold block. One can then pour a molten metal, which expands during a solidification phase to form an interference fit, into the expandable mold having the mold casting volume. By maintaining the mold casting volume as the molten metal solidifies it causes a pressure increase in the metal within the expandable mold. By expanding the expandable mold after at least partial solidification of the molten metal one creates a mold cavity solidification volume which is larger than the mold casting volume so that the molten metal which solidified therein forms a non-interference fit with at least a part of the expandable mold to thereby permit at least a partial release of the solidified metal from the mold.

In addition, if one pours a molten metal that contains sufficient bismuth to cause expansion of the molten metal during a solidification phase and allows the molten metal to solidify sufficiently to increase the pressure in the solidified metal to a level such that it compress at least a surface portion of the cast article one can produce a smooth finished surface on the solidified metal before expanding the expandable mold. If the solidified metal article is removed from the mold by laterally separating the mold parts one can both free the article from the mold block as well as produce a mold article with a smoothly finished surface that one would normally encounter in a cold working process.

We claim:

1. A mold assembly for casting a fishing sinker that expands upon solidification comprising:

a mold block having a converging sidewall therein;

a first mold part, said first mold part having a first face having a portion of a mold cavity therein and a second face for engaging a portion of the converging sidewall of the mold block;

a second mold part, said second mold part having a first face having a further portion of a mold cavity therein and a second face for engaging an opposite portion of the converging sidewall of the mold block, said first mold part and.said second mold part positionable in a condition to create a mold cavity of a first volume; and a member, said member located in an axial condition with respect to said first mold part and said second mold part to thereby generate a force to direct said first mold part and said second mold part in a direction outwardly of said mold block thereby causing said first mold part and said second mold part to laterally separate to increase the volume of the mold cavity therein and to free at least one of the mold parts from an interference fit with a solidified cast article to enable one to free the cast article from the remaining mold part without fracture of the cast article.

2. The mold assembly of claim 1 wherein the first mold part second face comprises an angled face for allowing lateral movement of said first mold part as said first mold part is axially displaced in said mold block and the first mold part second face extends for 180° or less.

3. The mold assembly of claim 2 wherein the second mold part second face comprises an angled face for allowing lateral movement of said second mold part as said first mold part is axially displaced in said mold block.

4. The mold assembly of claim 1 wherein the first mold part includes an angled tongue and a third mold part includes an angled groove with said angled tongue and said angled groove in sliding engagement so that an axial displacement of said first mold and said second mold part forces said first mold part away from said second mold part.

5. The mold assembly of claim 4 wherein the first mold part includes a second angled tongue and a fourth mold part includes an angled groove with said angled tongue on said fourth mold part in sliding engagement therewith.

6. The mold assembly of claim 1 wherein the member comprises a disc spring.

7. The mold assembly of claim 1 including a top plate for holding said first mold part and said second mold part in a condition where the volume of the mold cavity of the first volume is in a minimum volume condition.

8. The mold assembly of claim 1 wherein the outer surfaces of each of the mold parts diverge away from an apex end of the mold parts and a sidewall of the mold block converges toward a sidewall apex end of the mold block so that an axial displacement of said first mold part and said second mold part toward the sidewall apex end of the mold block to cause said first mold part and said second mold part to form the mold cavity of the first volume therein.

9. The mold assembly of claim 1 wherein a molten bismuth is located in the mold cavity of the first volume.

10. A method of casting a fishing sinker that expands during the solidification phase comprising:

placing an expandable mold in a mold block;

compressing the expandable mold to create a mold cavity having a mold casting volume by contracting the expandable mold within the mold block;

pouring a molten metal, which expands during a solidification phase to form an interference fit, into the expandable mold having he mold casting volume;

maintaining the mold casting volume as the molten metal solidifies thereby causing a pressure increase in the metal within the expandable mold; and expanding the expandable mold after at least partial solidification of the molten metal to create a mold cavity solidification volume which is larger than the mold casting volume so that the molten metal which solidified therein forms a non-interference fit with at least a part of the expandable mold to thereby permit at least a partial release of the solidified metal from the mold.

11. The method of claim 10 wherein the pouring of the molten metal comprises pouring a metal that contains sufficient bismuth to cause expansion of the molten metal during a solidification phase and allowing the molten metal to solidify sufficiently to increase the pressure in the solidified metal to a level such that it compress at least a surface portion of the cast article to thereby produce a finished surface on the solidified metal before expanding the expandable mold.

12. The method of claim 10 including the step of forming a converging sidewall in a mold block and a converging sidewall on the expandable mold so that axial displacement of the expandable mold in a first direction reduces the volume of the mold cavity and axial displacement of the expandable mold in an opposite direction increases the volume of the mold cavity to laterally draw the expandable mold away from the solidified metal in the mold.

13. The method of claim 10 including the step of placing a spring in the mold block to provide a separation force for the expandable mold.

14. The method of claim 10 wherein the step of placing an expandable mold comprising placing at least a two part expandable mold in the mold block.

15. The method of claim 10 wherein the step of placing an expandable mold comprises placing a set of cantilevered members in the mold block.

16. The method of claim 10 wherein the step of placing an expandable mold comprises placing a collet mold in the mold block.

17. The method of claim 10 wherein the step of enlarging the mold is initiated during a solidification phase of the molten metal when the metal has obtained a final shape but not necessarily a final dimensional state.

18. The method of claim 10 including the step of compressing the mold comprises the step of axially displacing the mold parts to produce contact of a lateral face of each of the mold parts.

19. A mold assembly for casting metal fishing sinkers that expand during a solidification phase comprising:

a mold block, said mold block having an opening with a sidewall therein;

an expandable mold having a further sidewall for engaging the sidewall of said mold block to hold the expandable mold in a casting condition and then allow lateral expansion of a mold cavity having a plurality of faces therein to thereby prevent a cast article that expands upon solidification from remaining in an interference fit with all the plurality of faces of the expandable mold.

20. The mold assembly of claim 19 wherein the expandable mold has at least two parts that together form the mold cavity for casting a fishing sinker from bismuth.

21. The mold assembly of claim 19 wherein the expandable mold has at least two parts that together form the mold cavity for casting a fishing sinker from a bismuth alloy.

* * * * *